US008356981B2

(12) United States Patent
Cooke et al.

(10) Patent No.: US 8,356,981 B2
(45) Date of Patent: Jan. 22, 2013

(54) GAS TURBINE ENGINE VANE ARRANGEMENT

(75) Inventors: Philip J Cooke, Derbyshire (GB); Marcus McBride, Bristol (GB); Mark A Halliwell, Derby (GB)

(73) Assignee: Rolls-Royce PLC, London (GB)

( * ) Notice: Subject to any disclaimer, the term of this patent is extended or adjusted under 35 U.S.C. 154(b) by 1250 days.

(21) Appl. No.: 11/902,148

(22) Filed: Sep. 19, 2007

(65) Prior Publication Data

US 2008/0080970 A1 Apr. 3, 2008

(30) Foreign Application Priority Data

Oct. 3, 2006 (GB) ..... 0619426.0

(51) Int. Cl.
*F04D 29/34* (2006.01)

(52) U.S. Cl. ..... 416/214 A

(58) Field of Classification Search ..... 415/134, 415/137, 139, 173.1, 173.3, 209.2, 209.3; 416/190, 191, 192, 244 A, 244 R
See application file for complete search history.

(56) References Cited

U.S. PATENT DOCUMENTS

| | | | | | |
|---|---|---|---|---|---|
| 2,220,914 | A | * | 11/1940 | Robinson | 416/191 |
| 2,221,684 | A | * | 11/1940 | Smith | 416/191 |
| 3,362,681 | A | * | 1/1968 | Smuland | 415/115 |
| 4,050,843 | A | | 9/1977 | Needham et al. | |
| 4,314,793 | A | * | 2/1982 | DeTolla et al. | 415/135 |
| 4,720,236 | A | * | 1/1988 | Stevens | 415/136 |
| 4,863,345 | A | * | 9/1989 | Thompson et al. | 415/174.1 |
| 5,634,768 | A | * | 6/1997 | Shaffer et al. | 415/137 |
| 5,645,398 | A | * | 7/1997 | Benoist et al. | 415/134 |
| 5,839,878 | A | * | 11/1998 | Maier | 415/209.2 |
| 6,062,813 | A | * | 5/2000 | Halliwell et al. | 415/174.5 |
| 6,129,513 | A | * | 10/2000 | Halliwell et al. | 415/173.4 |
| 6,499,993 | B2 | * | 12/2002 | Steber et al. | 431/352 |
| 7,195,452 | B2 | * | 3/2007 | Allan et al. | 415/135 |
| 2005/0244267 | A1 | * | 11/2005 | Coign et al. | 415/189 |
| 2006/0062673 | A1 | * | 3/2006 | Coign et al. | 416/214 A |

FOREIGN PATENT DOCUMENTS

GB 2 169 038 A 7/1986

* cited by examiner

*Primary Examiner* — Richard Edgar
*Assistant Examiner* — Aaron R Eastman
(74) *Attorney, Agent, or Firm* — Oliff & Berridge, PLC

(57) ABSTRACT

Within gas turbine engines is necessary to provide nozzle guide vanes between stages of the engine. These vanes are presented in vane segments and it is desirable to prevent leakage to retain engine operation efficiency as well as to avoid hot gas impingement on inappropriate parts of the engine. By use of anti-rotation blocks twisting between the segments can be prevented and therefore the segments retained in alignment. However, thermal distortion may open a chordal seal provided to inhibit gas flow leakage. By provision of chordal bumps it is possible to prevent forward rocking which will inhibit gaps between the chordal seal and an engaging support ring surface. Furthermore the anti-rotation blocks will generally incorporate appropriate mating surfaces to engage the chordal bumps across two or more vane segments to facilitate retention of vane segment alignment while achieving adjustment for thermal distortion.

11 Claims, 6 Drawing Sheets

GAS TURBINE ENGINE VANE ARRANGEMENT

The present invention relates to vane arrangements and more particularly to high pressure nozzle guide vanes used in gas turbine engines.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

In view of the above, it will be appreciated that control of fluid flows through a gas turbine engine is important to achieve efficiency and performance. In such circumstances guide vanes are utilised in order to direct and present gas flows generated by the compressor and turbine stages of an engine. These vanes generally act between the stages of the engine and in particular the compressor stages to direct and guide the air flow. It will be appreciated that the guide vanes are presented radially generally in the form of segments about the circumference of an engine. The segments have a vane mounting rail which is typically secured and clamped between respective members. Ideally leakage of gas flows through the mountings for the arrangement should be eliminated or at least minimalised. However previously such leakage has been simply accepted in view of the inherent distortions as a result of thermal expansion and contraction within the engine.

In accordance with aspects of the present invention there is provided a vane arrangement for a gas turbine engine, the arrangement comprising an anti-rotation block, a support ring and a vane mounting rail therebetween, the vane mounting rail comprising a chordal seal to seal against the support ring, the arrangement characterised in that the vane mounting rail has a curved contact surface to engage the anti-rotation block, at least part of the curved contact surface acting as a pivot about which the vane mounting rail can rock to maintain the chordal seal in response to thermal distortion of the arrangement in use.

Typically, the support ring comprises a plurality of segments aligned with each other to form an annulus.

Generally, the curved contact surface extends away with a forward lean at a rake angle to facilitate pivot.

Possibly, the curved contact surface has chordal bumps for contact with the anti-rotation block.

Typically, each anti-rotation block extends over two vane mounting rails.

Generally, the anti-rotation block has an interface to mate with the chordal bumps.

Generally, the arrangement comprises a plurality of vanes having a respective vane mounting rail engaged by a plurality of anti-rotation blocks in order to prevent displacement of the chordal seal from engagement with the support ring and to maintain alignment of the vane mounting rails to inhibit twist under load.

Generally, the anti-rotation blocks are securely mounted to parts of a gas turbine engine. Typically, the blocks are engaged by dog members in the vane mounting rail to prevent rotation.

Also in accordance with aspects of the present invention is provided a gas turbine engine incorporating a vane arrangement as described above.

A vane arrangement in accordance with aspects of the present invention will now be described by way of example only and with reference to the accompanying drawings in which:—

As indicated above preservation of a seal about a high pressure vane arrangement in a gas turbine engine has advantages with regard to maintaining efficiency and operational performance. It will be understood that leakage of fluid flow will inherently reduce the efficiency of the propulsion force provided by the engine as well as provide a heating problem for incident ports. Nevertheless, it will also be understood that the thermal gradients experienced by a gas turbine engine will cause expansion and where appropriate contraction of the vane segments presented together to form an annulus about the engine flow path. Ideally, the vane arrangement should be adaptable to accommodate for these thermal distortions.

Figure 2:
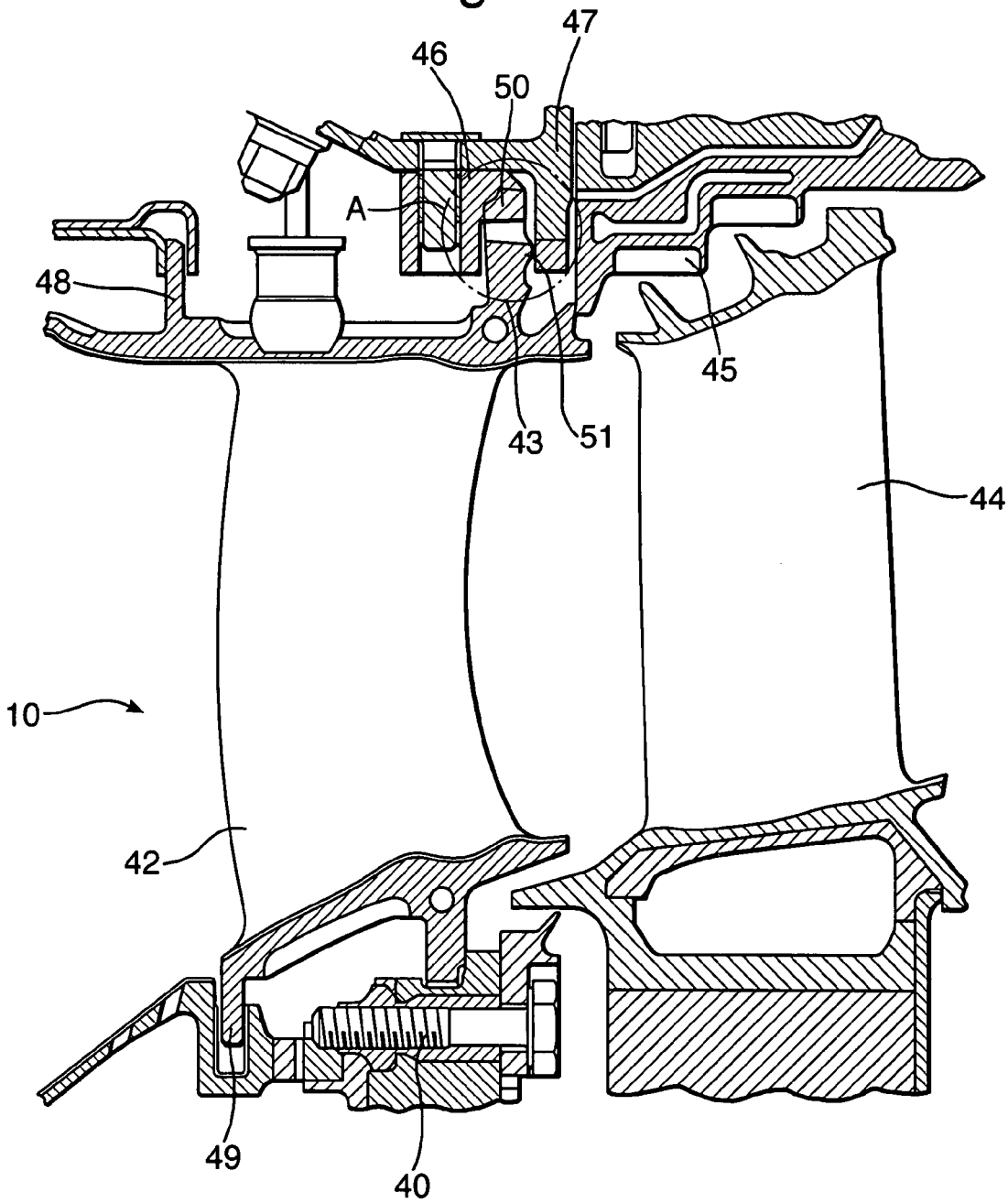
FIG. 2 is a schematic illustration of a vane arrangement located within a portion of a gas turbine engine.

FIG. 2 provides a side part cross sectional view of a gas turbine engine incorporating a vane arrangement in accordance with aspects of the present invention. Thus, the engine 10 has a vane 42 secured through mountings including a vane mounting rail 43. A blade 44 is arranged to rotate in use within a seal segment 45. As can be seen the vane mounting rail 43 is securely located between respective features of an anti-rotation block 46 and a support ring 47. As can be seen the vane 42 also has other positioning rims 48, 49 as well as a bolt assembly 40 to secure its position. In use the engine 10 and in particular the vane arrangement in the area defined by circle area A will be subject to high temperatures and flow pressures. Maintaining position as well as seal efficiency under such thermal distortions is advantageous.

Figure 3:
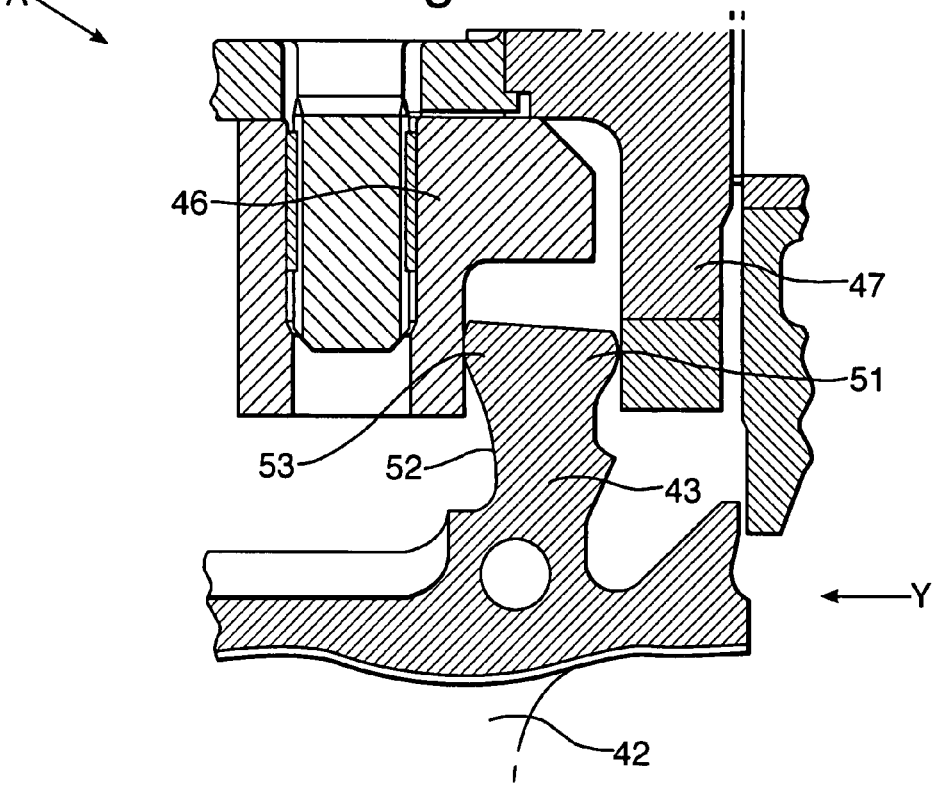
FIGS. 3 and 4 are expanded illustrations of the vane arrangement portion in accordance with aspects of the present invention depicted in FIG. 2.
Figure 4:
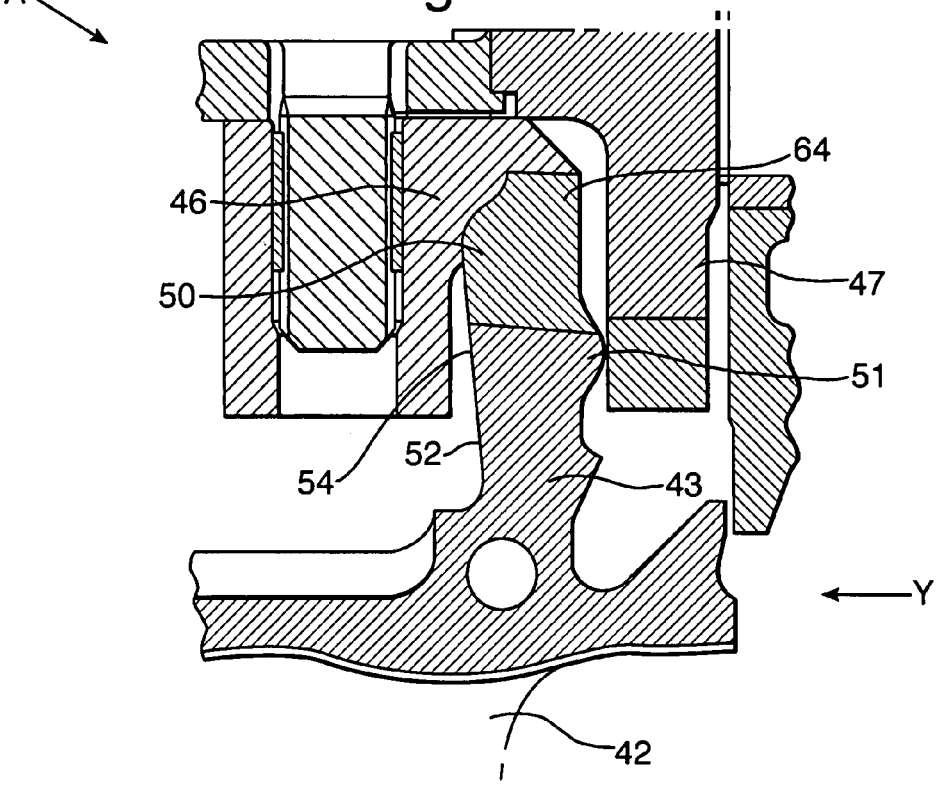

FIG. 3 and FIG. 4 provide an expanded illustration of the vane arrangement area A depicted in FIG. 2. The same reference nomenclature has been utilised for comparison. FIG. 3 is a view on the circumferential edge of the mounting rail 43. FIG. 4. is a sectional view through the circumferential centre of the mounting rail 43. As can be seen the rail 43 is constrained by a clamping effect between the anti-rotation block 46 and a segmented support ring 47. There is a chordal bump 53 provided at each circumferential edge on the front face 52 of the mounting rail 43 at its radially outer extent which, in accordance with aspects of the present invention, engages part of the anti-rotation block 46. These chordal bumps 53 are only present at the circumferential edges of the mounting rail 43 segment due to the slightly concave shape of the front face 52 of the mounting rail 43 at its radially outer extent. Towards the circumferential centre of the mounting rail 43, as depicted in FIG. 4, there is no chordal bump 53 but instead the radially outer extent 54 of the front face 52 of the mounting rail 43 is spaced apart from the anti-rotation block 46.

Figure 1:
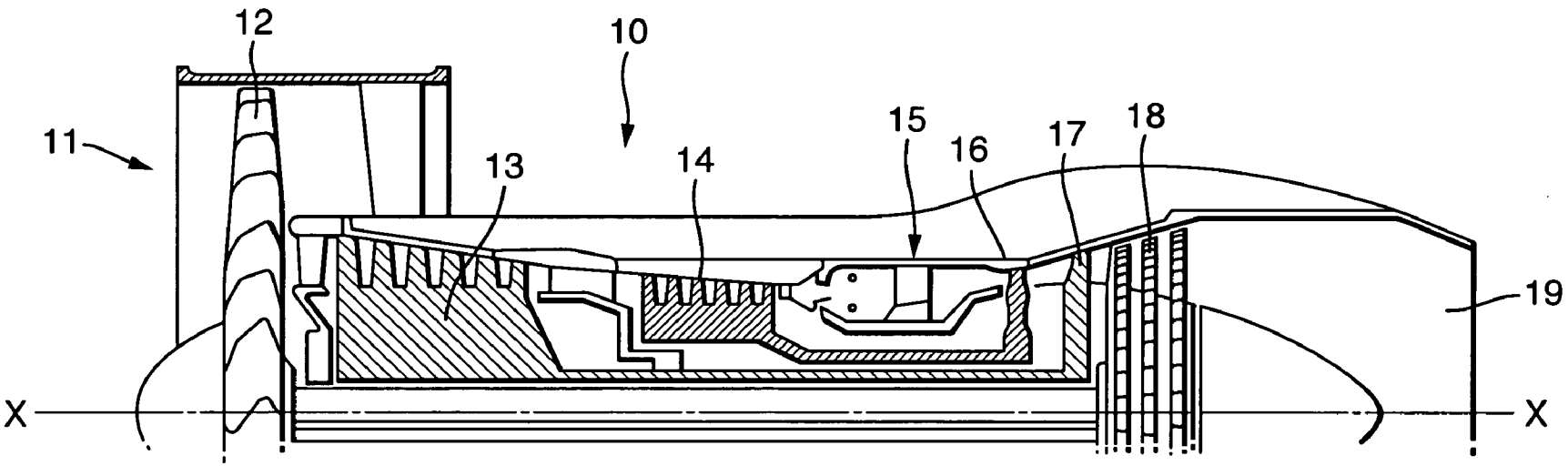
FIG. 1 is a schematic section through part of a gas turbine engine.

A chordal seal 51 takes the form of a rearwardly extending bump or ridge that extends in a straight line between the circumferential edges of the mounting rail 43 segment. Thus, it seals against the support ring 47 as a chord of the circle defined by the annulus of the engine 10. A plurality of mounting rail 43 segments are arrayed around the centre line X of the engine 10 (see FIG. 1) so that the seal formed by the chordal seals 51 on each segment form a regular polygon seal against the support ring 47. Typically there are twenty mounting rail 43 segments and the seal formed is therefore a twenty-sided polygon. The chordal seal 51 is maintained in contact through expected transit thermal conditions within the engine 10.

In such circumstances it will be appreciated that an effective seal is provided across and between the anti-rotation block 46 and the support ring 47. The anti-rotation block 46 will generally be part of or secured to an outer housing or engine structure to provide a robust location in order to inhibit rotation and twisting of the vanes in use.

FIG. 4 also shows an anti-rotation dog member 64 that extends radially outwardly from a circumferentially central portion of the mounting rail 43 to engage the anti-rotation block 46. There is a curved feature 50 on the front face of the dog member 64 that is formed by the preferred radial machining process.

The front face 52 extends away at a rake angle to allow some pivot flexibility about the chordal bumps 53 in use for adjustment to ensure that gaps do not develop between the chordal seal 51 and contact parts of the support ring 47. The actual width of the curved contact portions and spacing of the contact points will be dependant upon operational requirements.

It will be appreciated that pivotal engagement between the chordal bumps 53 and the anti-rotation blocks 46 maintains contact between the chordal seal 51 and the support ring 47. By provision of a forward lean in the front face 52 as well as the chordal bumps 53 it will be understood that a rocking action can be provided in response to thermal distortions and so maintain the chordal seal 51 contact with the support ring 47 as described. This rocking action is necessary in view of the hard mounting provided by the bolt assembly 40 tightly securing the vane 42 so that any differential movements must be accommodated by rocking of the radially outer vane mounting rail 43. It will also be appreciated in view of these rocking motions the chordal seal 51 must be a chord to accommodate for these rocking motions.

It will be appreciated the chordal bumps 53 and the chordal seal 51 are arranged where the vane mounting rail 43 is slightly thicker in the axial dimension. There is a chordal line between the chordal bumps 53 that engages with the anti-rotation blocks 46. These anti-rotation blocks 46 will typically have mating surfaces formed in their contact portions with the chordal bumps 53 in order to facilitate the rocking action against the mating surfaces to maintain chordal seal 51 in contact with the support ring 47.

Figure 5:
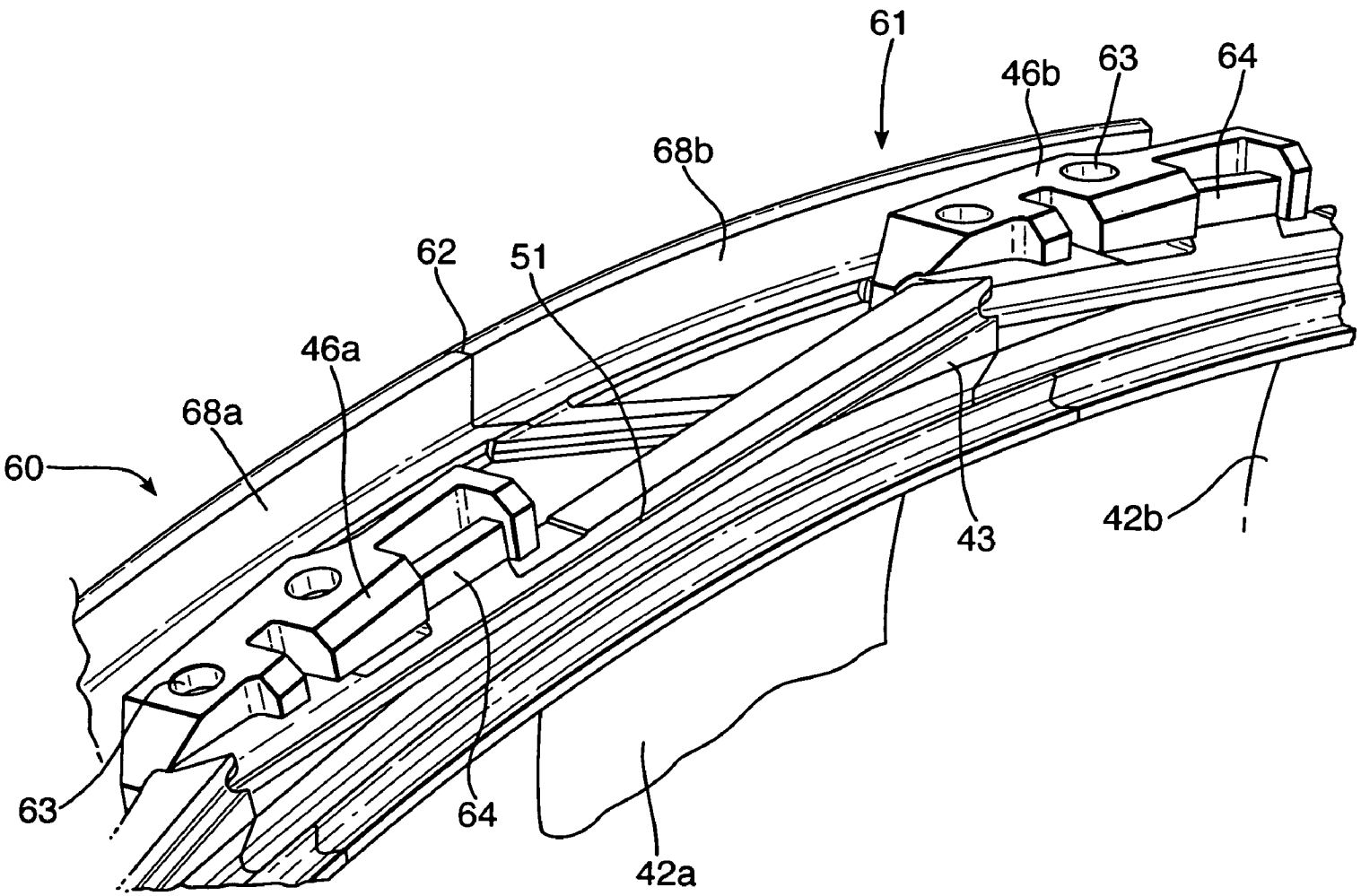
FIG. 5 is a schematic rear perspective view of a vane mounting arrangement illustrating blocks in accordance with aspects to the present invention.

FIG. 5 provides a rear perspective view of vane arrangements in accordance with aspects of the present invention. As can be seen vane segments are aligned and positioned next to each other in order to define a circumferential annulus in use. Only two part segments 60, 61 are shown in FIG. 5 for illustration purposes with front mounting rims 68*a*, 68*b*, illustrating positioning with a gap 62 between the segments 60, 61. The anti-rotation blocks 46*a*, 46*b* prevent rotation of the segments 60, 61 in order that the gap 62 is controlled. As can be seen apertures 63 are generally provided such that the blocks 46*a*, 46*b* can be securely mounted within an engine 10 with anti-rotation dog members 64 entering parts of the blocks 46*a*, 46*b* in order to prevent rotation. These dog members 64 are part of the vane mounting rail 43.

Although not shown, in accordance with aspects of the present invention chordal bumps 53 on the front face 52 of the mounting rail 43 will engage with parts of the blocks, 46*a*, 46*b* whilst a rear surface incorporates the chordal seal feature 51 (FIGS. 2, 3 and 4) for engagement with a support ring 47 (not shown).

The blocks 46*a*, 46*b* have a size and a position such that each overlaps two neighbouring vane segments 60, 61. In such circumstances, as indicated above, the chordal bumps 53 can accommodate distortion in order to prevent forward rocking and so opening of a gap between the chordal seal 51 and the opposed support ring 47 (not shown). It is by providing effectively bumper point contacts being the chordal bumps 53 (FIGS. 2 and 3) upon a front surface 52 of the vane mounting rail 43 along with appropriate reciprocal shaping of the anti-rotational blocks 46*a*, 46*b* that adjustment for thermal distortion in order to prevent gaps is achieved whilst also maintaining alignment through the anti-rotation blocks 46 and dog member 64 engagement in use under circumferential gas flow loadings over the vanes 42*a*, 42*b*.

The chordal bumps 53 effectively trap the mounting rail 43 between the support member 47 and reaction/mating surfaces of the anti-rotation block 46. The anti-rotation blocks 46 are designed as indicated to be elongated and react across more than one segment 60, 61 in order to eliminate vane 42 circumferential twist whilst maintaining the chordal seal 51 as described previously.

Figure 6:
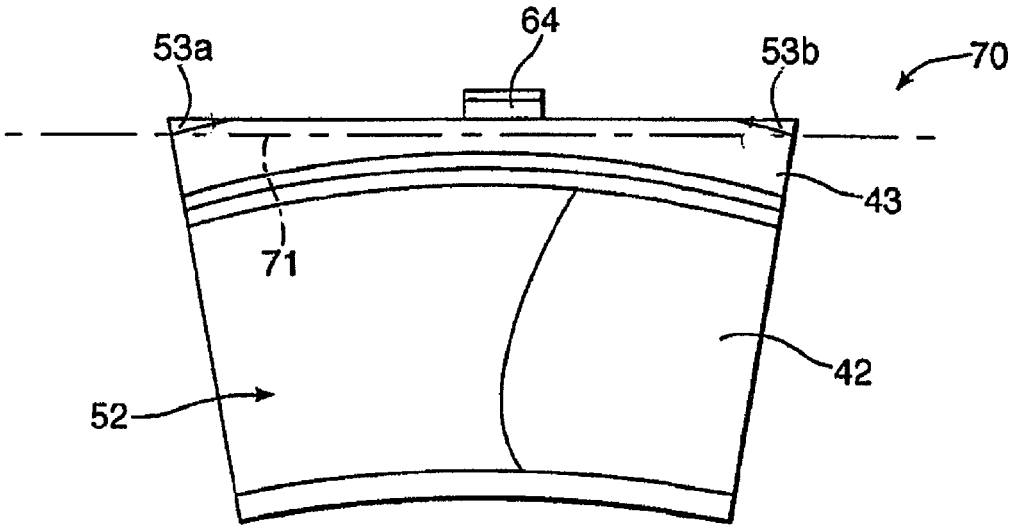
FIG. 6 is a schematic front illustration of a vane arrangement in accordance with aspects of the present invention; and, FIG. 7 is a perspective view of a vane mounting rail in accordance with aspects of the present invention.

FIG. 6 provides a schematic front view of a vane segment 70 in accordance with aspects of the present invention. As with previous figures the same reference numerals have been utilised for comparison. Thus, a vane 42 is defined in the segment 70 with a cross section consistent with a view in the direction of arrow head Y shown in FIGS. 3 and 4. In such circumstances a vane mounting rail 43 incorporates a front surface 52 which as indicated is curved and shaped such that chordal bumps 53*a*, 53*b* are produced through radial machining. In such circumstances the segment 70 can rock about an axis depicted by broken line 71. The chordal bumps 53, 53*b* will engage reciprocal and mating parts of an anti-rotation block 46 as described previously. In such circumstances forward rocking of the segment 70 which might cause disengagement of the rear facing chordal seal 51 (not shown) is prevented by the engagement between the chordal bumps 53*a*, 53*b* with the mating parts of the anti-rotation block 46. The dog member 64 engages with the anti rotation block 46 to prevent twisting in use from alignment of the segments 70 in the annular ring of segments as the anti-rotation blocks 46 span at least two vane segments 70. In such circumstances by provision of chordal bumps 53*a*, 53*b* thermal distortion can be accommodated whilst ensuring appropriate robust engagement by the chordal seal 51 against the support ring 47 (not shown) and inhibiting twist out of alignment of the segments 70 in use.

Figure 7:
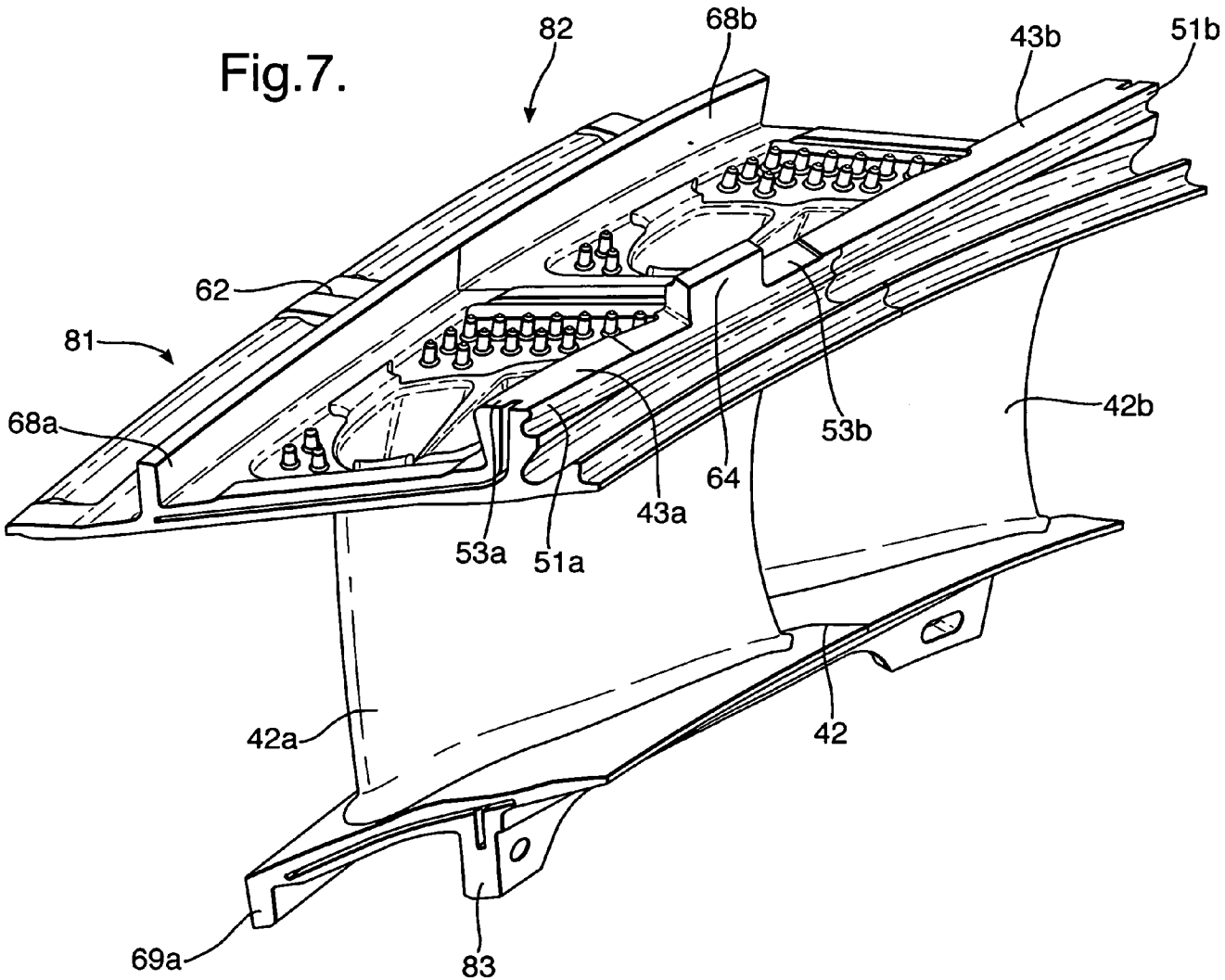

FIG. 7 provides a perspective view of two vane segments 81, 82 in accordance with aspects of the present invention. Similar reference nomenclature has been utilised with regard to consistent features described in earlier figures. Thus, vanes 42*a*, 42*b* are presented by the segments 81, 82 with front mounting rims 68*a*, 68*b*; positioning ring 69*a* and a rear mounting 83 through which a bolt 40 (FIG. 2) is secured. As can be seen the vanes 42*a*, 42*b* are generally hollow and present a rear mounting rail 43*a*, 43*b* with a chordal seal 51*a*, 51*b* to engage a support ring 47 (not shown) as described previously.

The rails 43*a*, 43*b* incorporate the chordal bumps 53*a*, 53*b* which engage with a mating surface of an anti-rotation block 46 as described previously in use. This anti-rotation block 46 also engages with a dog member 64 to prevent rotation around the engine axis X and twist around a radial axis whilst forward rocking is prevented by engagement of the chordal bumps 53*a*, 53*b* with the anti-rotation block 46 to ensure the chordal seals 51*a*, 51*b* remain in contact with the support ring 47 (not shown).

As can be seen in FIG. 7 vane segment 81 incorporates a dog member 64 whilst vane segment 82 does not incorporate such a dog member 64. However, as described above anti-rotation blocks 46 in accordance with aspects of the present invention will advantageously span two or more vane segments 81, 82 such that the aligned segments of mounting rails 43*a*, 43*b* may act as a continuous segment. In such circumstances the chordal bumps, 53*a*, 53*b* may be supplemented with further bumps in the curvature of the rail 43 across which the anti-rotation blocks 46 extend such that through engagement and mating appropriate presentation of the segments 81, 82 is achieved in operation.

As indicated vane arrangements in accordance with aspects of the present invention generally prevent forward rocking such that the chordal seal 51 remains in contact with the support ring 47 to provide a seal function whilst also inhibiting twisting as a result of gas flow forces presented to the vanes in operation. Thus, the segments 81, 82 remain substantially in alignment for operational efficiency. By retaining the chordal seal 51 there will be less gas flow leakage whilst preventing twisting will prevent gaps 62 opening in use again resulting in gas flow leakage. It will be appreciated that gas flow leakage reduces the overall efficiency of the engines and gas flows will be relatively hot and therefore should they impinge upon certain parts of the engine 10 will cause premature aging or a necessity for use of coolant flows to remain within operational parameters.

We claim:

1. A vane arrangement for a gas turbine engine having a rotation axis, the arrangement comprising:

an anti-rotation block including a receiving portion;

a support ring;

and a vane mounting rail therebetween, wherein the vane mounting rail comprises a chordal seal to seal against the support ring, wherein the vane mounting rail has a curved contact surface having circumferential edges defining chordal bumps, the chordal bumps engaging the anti-rotation block and acting as a pivot about which the vane mounting rail can rock to maintain the chordal seal in response to thermal distortion and twisting as a result of gas flow forces of the arrangement in use.

2. An arrangement as claimed in claim 1 wherein the curved contact surface extends away with a forward lean at a rake angle to facilitate pivot.

3. An arrangement as claimed in claim 1 wherein each anti-rotation block extends over two vane mounting rails.

4. An arrangement as claimed in claim 1 wherein the anti-rotation block has an interface to mate with the chordal bumps.

5. An arrangement as claimed in claim 1 wherein the arrangement comprises a plurality of vanes having a respective vane mounting rail engaged by a plurality of anti-rotation blocks in order to prevent displacement of the chordal seal from engagement with the support ring and to maintain alignment of the vane mounting rails to inhibit twist under load.

6. An arrangement as claimed in claim 5 wherein the anti-rotation blocks are securely mounted to parts of a gas turbine engine.

7. An arrangement as claimed in claim 5 wherein the anti-rotation blocks are engaged by dog members in the vane mounting rail to prevent rotation.

8. An arrangement as claimed in claim 1 wherein the support ring comprises a number of segments secured together to form an annulus.

9. A gas turbine incorporating a vane arrangement as claimed in claim 1.

10. An arrangement as claimed in claim 1 wherein the vane mounting rail comprises a dog member configured to be inserted into the receiving portion of the anti-rotation block to thereby prevent rotation about the engine's rotation axis.

11. An arrangement as claimed in claim 1 wherein the chordal bumps directly contact the anti-rotation block.

* * * * *